US006962203B2

(12) United States Patent
Funchess

(10) Patent No.: US 6,962,203 B2
(45) Date of Patent: Nov. 8, 2005

(54) ONE TRIP COMPLETION PROCESS

(75) Inventor: Thomas A. Funchess, Hazlehurst, MS (US)

(73) Assignee: Owen Oil Tools LP, Godley, TX (US)

( * ) Notice: Subject to any disclaimer, the term of this patent is extended or adjusted under 35 U.S.C. 154(b) by 0 days.

(21) Appl. No.: 10/395,667

(22) Filed: Mar. 24, 2003

(65) Prior Publication Data

US 2004/0188093 A1 Sep. 30, 2004

(51) Int. Cl.[7] ..... E21B 43/116

(52) U.S. Cl. ..... 166/297; 166/55.2; 166/63; 166/263; 166/278; 166/308.1

(58) Field of Search ..... 166/51, 55.2, 63, 166/257, 259, 263, 286, 297–299, 308.1, 278

(56) References Cited

U.S. PATENT DOCUMENTS

| | | | | |
|---|---|---|---|---|
| 4,091,868 A | * | 5/1978 | Kozlowski et al. | 166/277 |
| 4,428,431 A | | 1/1984 | Landry et al. | |
| 5,131,472 A | | 7/1992 | Dees et al. | |
| 5,271,465 A | | 12/1993 | Schmidt et al. | |
| 5,722,490 A | | 3/1998 | Ebinger | |
| 5,755,286 A | | 5/1998 | Ebinger | |
| 6,095,245 A | | 8/2000 | Mount | |
| 6,286,598 B1 | * | 9/2001 | van Petegem et al. | 166/297 |
| 6,494,261 B1 | * | 12/2002 | Pahmiyer | 166/281 |
| 2003/0230406 A1 | | 12/2003 | Lund | |

OTHER PUBLICATIONS

Ebinger, "New frac–pack procedures reduce completion costs", World Oil, Apr. 1996, pp. 71, 72 & 75.

Morales et al., "Current Practices . . . Gulf of Mexico", SPE paper No. 38578, 1997, pp. 147–158.

Handren et al., "Overbalance . . . Method for Wells", SPE paper No. 26515, 1993, pp. 87–96.

Snider et al., "Perforation Damage Studies . . . ", SPE paper No. 38635, 1997, pp. 677–690.

Ebinger, "Frac pack technology still evolving", Oil and Gas Journal, Oct. 23, 1995, pp. 61–70.

* cited by examiner

*Primary Examiner*—Zakiya Walker
(74) *Attorney, Agent, or Firm*—Jack E. Ebel

(57) ABSTRACT

A process and assembly for completing and providing sand control in a subterranean well and/or fracturing and preventing proppant flowback in a subterranean formation in a single trip. One or more perforating gun assemblies are juxtaposed and secured to one or more screen assemblies. Once positioned in a well adjacent a subterranean formation of interest, the explosive charges in each perforating gun assembly are detonated so as to penetrate the well and formation thereby initiating fracturing. The penetrations and the annulus defined between the well and screen assembly are then packed with gravel. Well fluid may be pressurized to in excess of the formation pressure prior to detonation of the explosive charges so as to enhance formation fracturing.

24 Claims, 10 Drawing Sheets

ONE TRIP COMPLETION PROCESS

BACKGROUND OF THE INVENTION

1. Field of the Invention

The present invention relates to a process for completing, providing sand control and/or fracturing a subterranean well in a single trip, and more particularly, to the use of one or more perforating gun assemblies positioned within a screen assembly to permit perforation of a well and formation while fluid in the well bore is pressured to an predetermined condition, such as an overbalanced condition, and proppant is subsequently placed in the well without removal of the assemblies.

2. Description of Related Art

Production of unconsolidated materials, e.g. sand and other fines, from subterranean formations into wells is problematic. Left unabated, continued production of such unconsolidated materials can result in erosion of production equipment, well plugging, and/or reduced or complete loss of fluid production from a well. Thus, it is conventional practice to control the production of unconsolidated materials into many subterranean wells. Where the subterranean formation is composed of relatively hard, consolidated material and fracturing operations are performed so as to enhance fluid communication with the well, conventional practice is to control the flow of proppant that is utilized in the fracturing operations back into the well thereby ensuring that the fractures remained propped open.

In accordance with the most commonly practiced technique, "gravel packing", a tubular liner is positioned in the well bore and a proppant gravel is placed in the annulus between the liner and the well bore. Gravel is commonly mixed with the fluid, such as a liquid or foam, to form a slurry which is pumped through a work string and a crossover tool into the annulus between the well bore and the liner. The slurry flows down the annulus to the bottom of the well bore or to a sump packer in the well bore. Some of the fluid of the slurry flows through the apertures in the liner into the open bottom end of a wash pipe situated within the liner and returns to the surface through the crossover tool and the annulus between the work string and the well casing. The bulk of the slurry fluid flows into the subterranean zone through perforations in the well bore. Gravel is thus deposited in the annulus and against the subterranean zone. The liner has slots or other apertures in its walls which are smaller in size than the gravel particles, thereby permitting formation fluids to flow through the slots while preventing entry of any unconsolidated materials. Gravel packing operations are typically performed at pressures below the formation fracture gradient, and the primary design considerations are placement of proppant inside perforation tunnels and in the annulus between the well bore and liner. The small apertures may be provided by a screen encircling the outer circumference of the liner tube, in which case the openings in the tube may be larger than the gravel particles. As a result of improved technology, gravel packs have become quite effective in excluding sand from oil and gas production. In addition to this function, the gravel also assists in supporting the walls of uncased wells and preventing caving of loose material against the liner. Despite the effectiveness of gravel packs once they are properly placed and operating, the procedure often results in undesirable completion skins or damage to the walls of the well bore which reduce the flow of formation fluids into a well.

In accordance with a relatively recent technique of completing well bores while practicing sand control termed "frac packing", the unconsolidated formation is fractured and propping material is deposited in the fracture. Typically, a completion fluid of sufficient density for pressure control is first placed in a cased well, the cased well is perforated adjacent the subterranean zone or formation of interest. The perforating equipment is then removed from the well and a separate trip is required to place sand control equipment in the well adjacent the perforations. A fracturing fluid having proppant material incorporated therein is pumped, with the sand control equipment in place, at a sufficiently high pressure to propagate a fracture into the subterranean formation. The proppant materials within the fracturing fluid are deposited in the resulting fracture(s). While several variations of this process are practiced, the steps set forth above are employed to complete a given frac pack operation. However, significant costs are incurred with the material, equipment and time necessary to perform this series of operations.

The problems associated with conventional frac packing operations have spawned significant interest in reducing fluid costs, in developing simplified equipment and methods for minimizing the number of trips necessary to deploy equipment in the well and in eliminating the use of a rig at the surface of the earth. Methods and apparatus have been recently developed that allow perforating operations and screen placement to be performed in a single trip. U.S. Pat. No. 5,722,490 discloses a method of completing and hydraulically fracturing a well wherein a tubing conveyed perforating gun assembly is attached below a gravel pack screen. The perforating gun assembly is lowered to a depth opposite a productive zone and activated. The perforating gun assembly may be designed to be released from the tubing and fall to the bottom of the well after firing. The tubing string is then lowered to place the gravel pack screen opposite at least one of the perforations formed. Hydraulic fracturing operations are subsequently performed. However, this method still requires intervention with a rig to perform operations for positioning, perforating, setting of packer(s), etc. that are necessary to accomplish the method. Accordingly, a need still exists for a cost effective method for providing the stimulation benefits of a frac pack method together with sand control without necessarily requiring the use of a rig at the surface of the earth.

Methods have also recently been developed for exerting extreme pressures on a subterranean formation instantaneously with perforating the well casing so as to clean the perforation tunnels that are formed and to generate near-wellbore fractures to connect with existing natural fractures in the formation. U.S. Pat. No. 5,131,472 discloses such a method and provides for non-mechanical sand control by use of resin coated sand. However, a need exists for performing an overbalanced perforating operation while utilizing mechanical means and methods to provide for increased sand control, decreased time and costs and increased safety.

SUMMARY OF THE INVENTION

To achieve the foregoing and other objects, and in accordance with the purposes of the present invention, as embodied and broadly described herein, one characterization of the present invention may comprise a process for completing a well is provided which comprises positioning at least one explosive charge juxtaposed to a screen that is positioned in a well and detonating the at least one explosive charge.

In another characterization of the present invention, a process is provided for completing a subterranean well which comprises securing at least one explosive charge radially juxtaposed to a screen, positioning the screen and the at least one explosive charge in a subterranean well adjacent a subterranean formation, and detonating the at least one explosive charge thereby perforating the subterranean formation.

In yet another characterization of the present invention, a one trip well process is provided for fracturing a subterranean formation and for completing a well penetrating the formation. The one trip process comprises pressuring fluid present in a subterranean well to an predetermined condition and forming perforations in the well while a screen assembly is present in the well adjacent a subterranean formation, the fluid causing said formation to fracture.

In still another characterization of the present invention, a one trip well process for fracturing a subterranean formation and for completing a well penetrating the formation is provided. The process comprises pressuring fluid present in a subterranean well to an overbalanced condition and forming perforations in the well, said fluid causing said formation to fracture. A slurry of gravel is injected into an annulus defined between the well and the screen assembly thereby packing the perforations with the gravel and forming a gravel pack in the annulus.

In a still further characterization of the present invention, a one trip process for completing a well is provided which comprises securing at least one perforating gun assembly in a juxtaposed relationship to a screen assembly, positioning the at least one perforating gun assembly and the screen assembly in a well adjacent a subterranean formation, and pressurizing fluid in the well to an overbalanced condition thereby detonating the at least one perforating gun assembly so as to form perforations in the subterranean formation. The pressured fluid fractures the formation via the perforations.

In a still further characterization of the present invention, a well completion assembly is provided which comprises a screen assembly having at least one aperture, at least one perforating gun assembly having at least one explosive charge, and a pressure activated firing assembly connected to the at least one perforating gun assembly. The at least one perforating gun assembly is positioned within the aperture and secured to the screen assembly such that each of said at least one explosive charge is aimed through said at least one aperture.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

Figure 1:
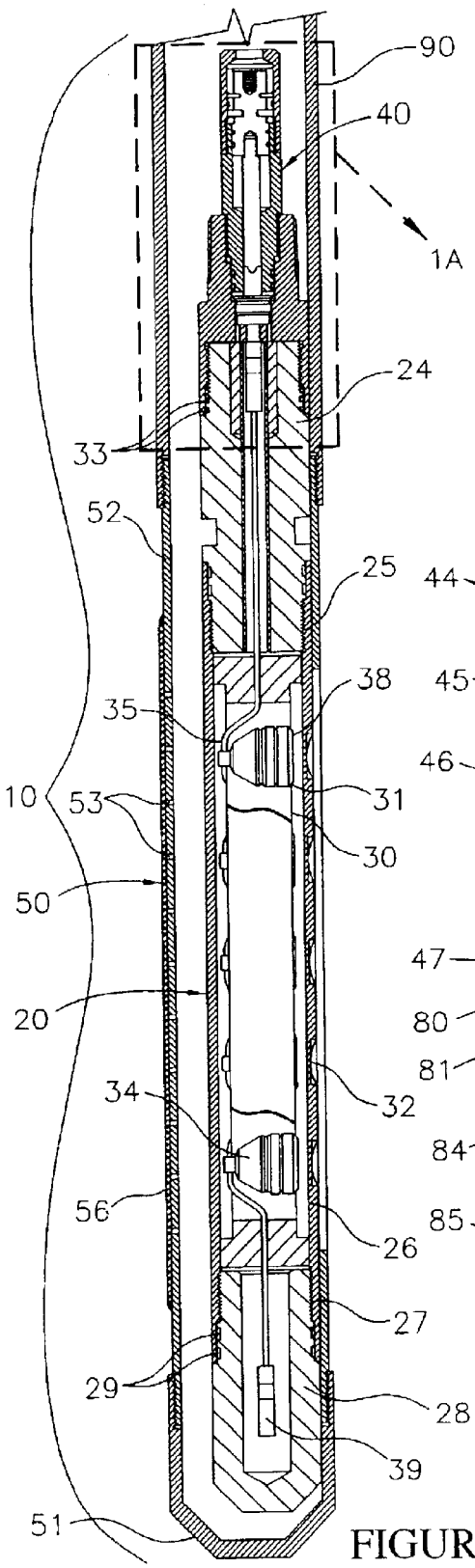
FIG. 1 is a partial cross sectional view of one embodiment of the assembly of the present invention.

One embodiment of the assembly of the present invention is illustrated generally as 10 in FIG. 1. Assembly 10 is comprised of a perforating gun assembly 20 and a firing assembly 40 secured to each other and positioned within a screen assembly 50 that is secured to the end of a tubular 90. Perforating gun assembly, as illustrated, is comprised of a sub 24, a perforating charge carrier 26 and a bull plug 28. One end of the perforating charge carrier 26 is attached to sub 24 by any suitable means, such as by screw threads 25. A pair of O-rings 33 provide a fluid tight seal between carrier 26 and sub 24. The other end of perforating charge carrier 26 is attached to bull plug 28 by any means, such as screw threads 27 and O-rings 29 which provide a fluid tight seal therebetween. Charge carrier 26 and perforating charge tube 30 are generally tubular. Perforating charge tube 30 is designed to be aligned as positioned inside perforating charge carrier 26 so that the large ends 38 of charges 34 are adjacent scallops 32 formed in the exterior of perforating charge carrier 26. As illustrated, openings 31 in the wall of charge tube 30 are positioned generally linear along axis of the tube. Although charges 34 are preferably lined charges, any other equivalent charge, explosive or bullet known to those skilled in the art as useful in perforating casing and/or a subterranean formation may be utilized in the assembly and process of the present invention. The charge, explosive or bullet may be designed to produce any suitably configured perforation or hole in the casing and/or subterranean formation, such as round, oblong, linear, etc. A detonating cord 35 is connected to the firing assembly 40 above sub 24, to the small end 35 of each perforating charge 34, and to an aluminum or rubber closure 39 in bull plug 28. Where another gun assembly 20 is threaded onto the perforating charge carrier 26 in lieu of bull plug 28, reference numeral 39 would refer to a booster transfer as will be evident to a skilled artisan.

Figure 1A:
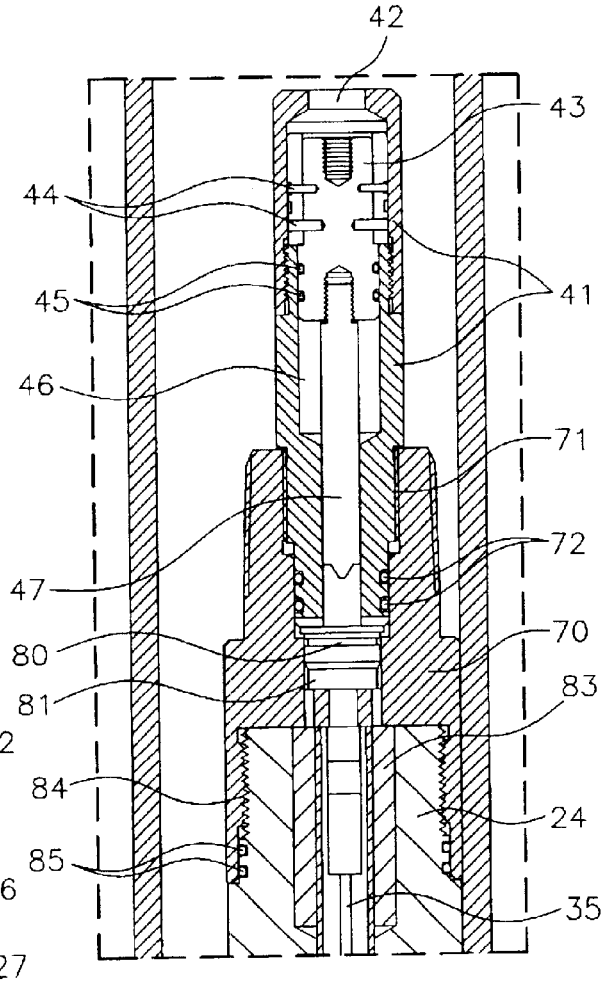
FIG. 1A is a cross sectional view of a pressure firing head assembly that may be utilized in conjunction with the assembly and process of the present invention that is illustrated in FIG. 1.

Any suitable detonating system known to those skilled in the art may be used in the assembly and process of the present invention. The detonating system may be electrical or mechanical, may be used in conjunction with a timer, and may be initiated by fluid pressure (gas or liquid), electrical current, and/or any other suitable means, such as electromagnetic or acoustic signals as will be evident to a skilled artisan. An example of a detonating system suitable for use with the assembly of the present invention is illustrated in FIG. 1A. A vent 42 is provided in one end of vent housing 41 while the other end of vent housing is secured to a firing head 70 by any suitable means, such as by screw threads 71 and O-rings 72 to provide a fluid tight seal there between. A piston 43 is positioned within housing 41 and is releasably secured therein by means of shear pins 44. O-rings 45 provide a fluid tight seal between piston 43 and housing 41. An annular chamber 46 between piston 43 and the interior wall of housing 41 is filled with air. A firing pin 47 is connected to and extends downward from the bottom of piston 43. A percussion firing assembly 81 is retained within firing head 70 by the pin end of housing 41. Sub 24 is attached to firing head 70 by any suitable means, such as by screw threads 84 and O-rings 85 to provide a fluid tight seal there-between. An ignition transfer 83 at the top of sub 24 is in contact with detonating cord 35 passing through the perforating charge carrier 26, as described above.

Figure 2A:
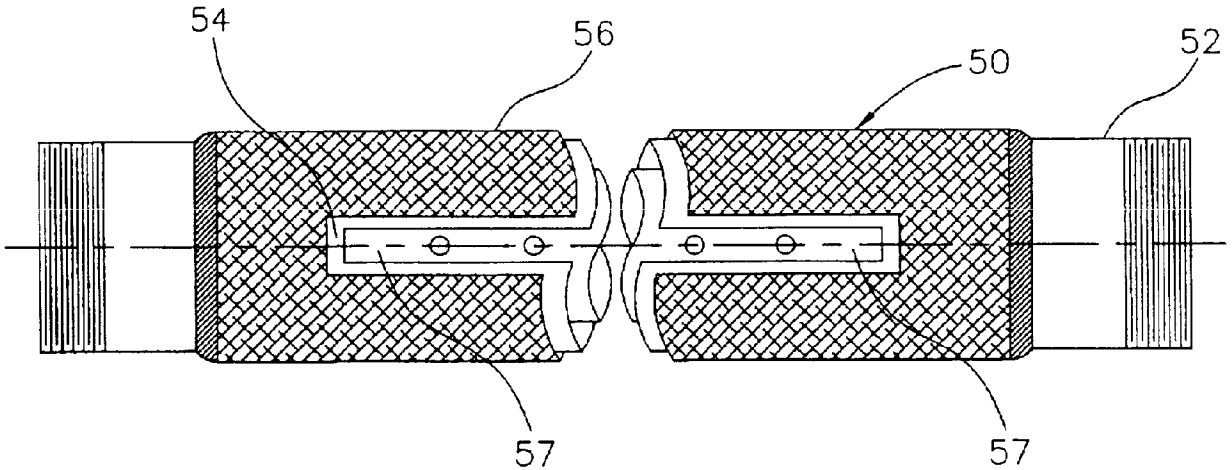
FIG. 2A is a partially cutaway view of the embodiment of a screen assembly illustrated in FIG. 2 which has been rotated to illustrate apertures in the perforating charge carrier.
Figure 2:
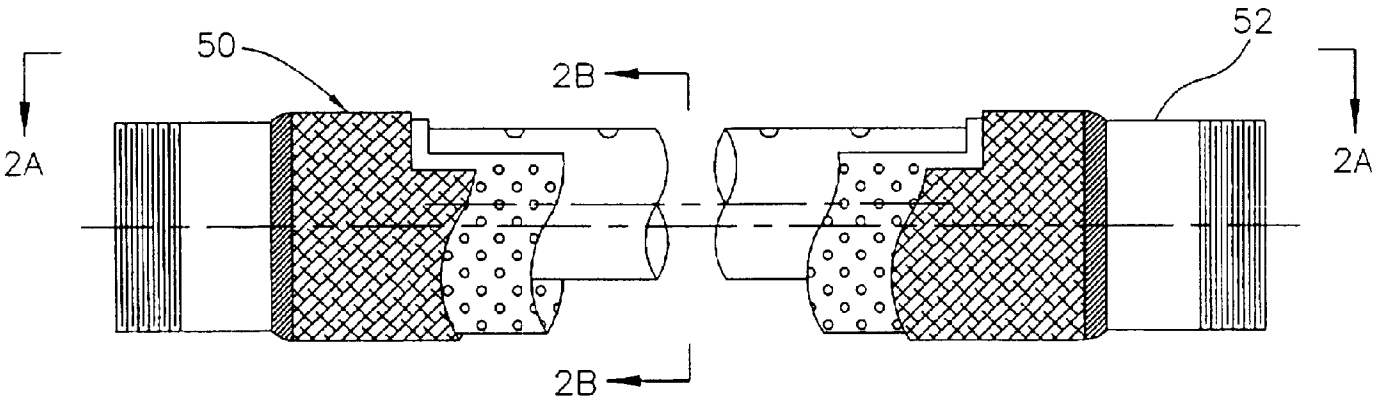
FIG. 2 is a partially cutaway view of one embodiment of a screen assembly used in the assembly and process of the present invention.
Figure 2B:
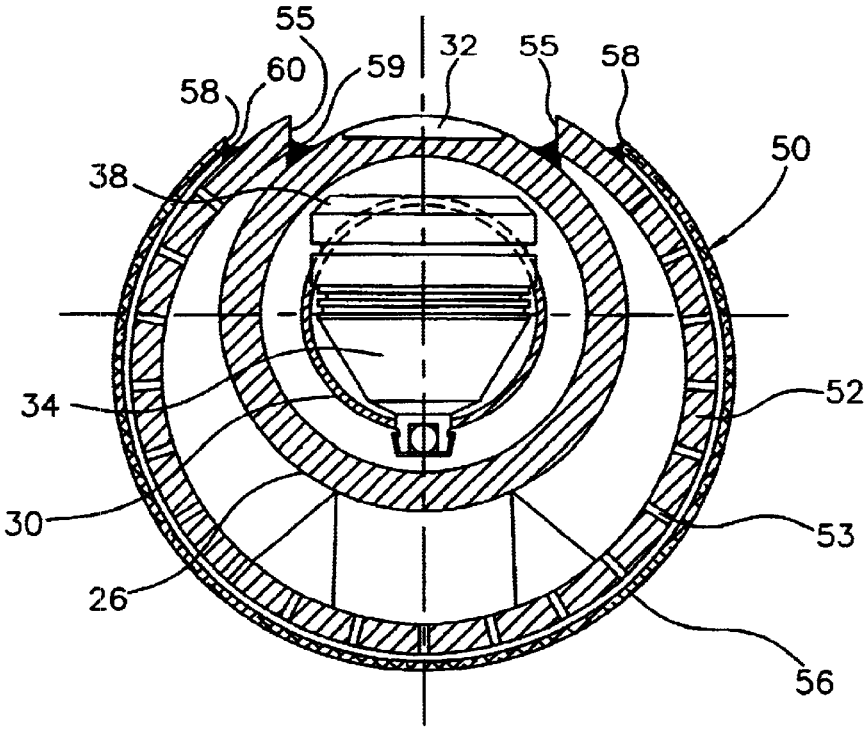
FIG. 2B is a cross sectional view of the embodiment of a screen assembly taken along line 2B—2B in FIG. 2.
Figure 3B:
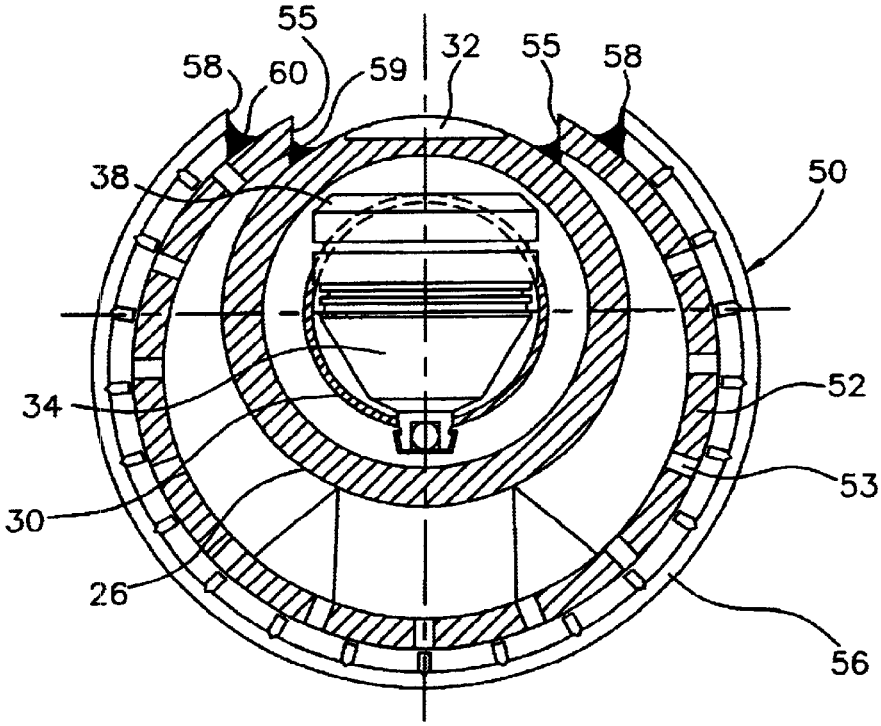
FIG. 3B is a cross sectional view of the embodiment of a screen assembly taken along line 3B—3B in FIG. 3.
Figure 3A:
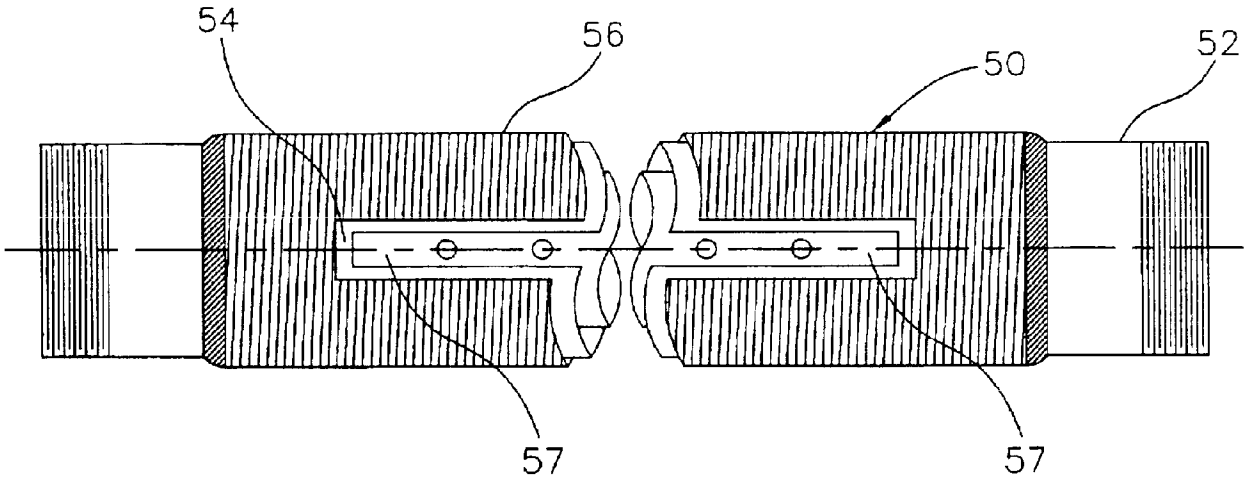
FIG. 3A is a partially cutaway view of the embodiment of a screen assembly illustrated in FIG. 3 which has been rotated to illustrate apertures in the perforating charge carrier.
Figure 3:
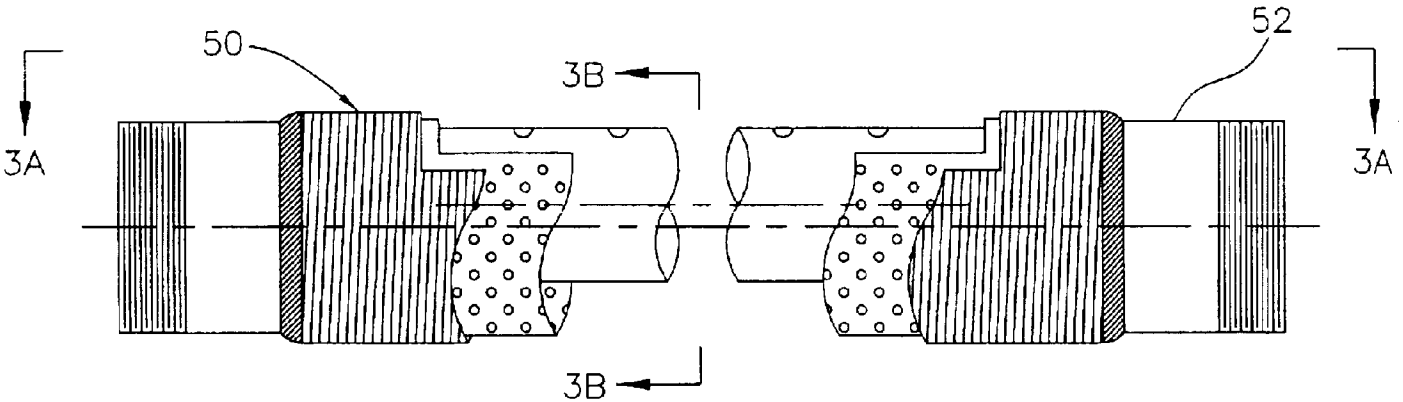
FIG. 3 is a partially cutaway view of another embodiment of a screen assembly used in the assembly and process of the present invention.

As illustrated in FIG. 1, a screen assembly 50 has one end thereof secured to an end plug 51 while the other end thereof is secured to a length of tubular 90, such as a section of blank pipe which may be attached to a packer assembly or designed for a screen assembly. Tubular 90 typically has a length of about 60 to 90 feet. In accordance with the present invention, screen assembly 50 is comprised of a pipe 52 having apertures 53 therethrough. A generally tubular screen 56 is positioned about the pipe so as to cover apertures 53 and the ends of screen 56 are secured to pipe 52 by any suitable means, such as by welds. Screen 56 may be any conventional screen employed for sand control, as will be readily evident to a skilled artisan. For example, screen 56 may be a conventional wire wrapped screen such as illustrated in FIGS. 3, 3A and 3B and commercially available from the Johnson Screens, a Weatherford Company, under the trademark SuperWeld® or a sintered laminate such as is illustrated in FIGS. 2, 2A and 2B and commercially available from Johnson Screens under the trademark Excelflo™.

In accordance with the present invention, firing assembly 40 and perforating gun assembly 20 are positioned within and axially offset to one side of the interior of screen assembly 50 and tubular 90 and secured thereto in a manner described below. The screen assembly is provided with an aperture or opening which is configured to encompass scallops 32 that are formed in the exterior of perforating charge carrier 26. Specifically, as illustrated in FIGS. 2A and 3A, the aperture in screen assembly 50 is formed of an aperture 54 in perforated pipe 52 and an aperture 57 in screen 56 that is configured substantially similar to but is slightly larger than aperture 54. As illustrated in FIGS. 2B and 3B, pipe 52 is secured to perforating charge carrier 26 at or near the edges 55 of aperture 54 in pipe 52 by any suitable means, such as welds 59, so as to form a seal between pipe 52 and perforating charge carrier 26 that is sufficient to prevent proppant entry. In a similar manner, screen 56 is secured to pipe 52 at or near the edges 58 of aperture 57 in screen 56 by any suitable means, such as welds 60, so as to form a seal between screen 56 and pipe 52 that is sufficient to prevent proppant entry. Although charge carrier 26 and charge(s) 34 are illustrated in FIGS. 2B and 3B as being within screen assembly 50, it will be evident to a skilled artisan that aperture 54 may be sized such that both charge carrier and charges 34 protrude outwardly from screen assembly.

Figure 4:
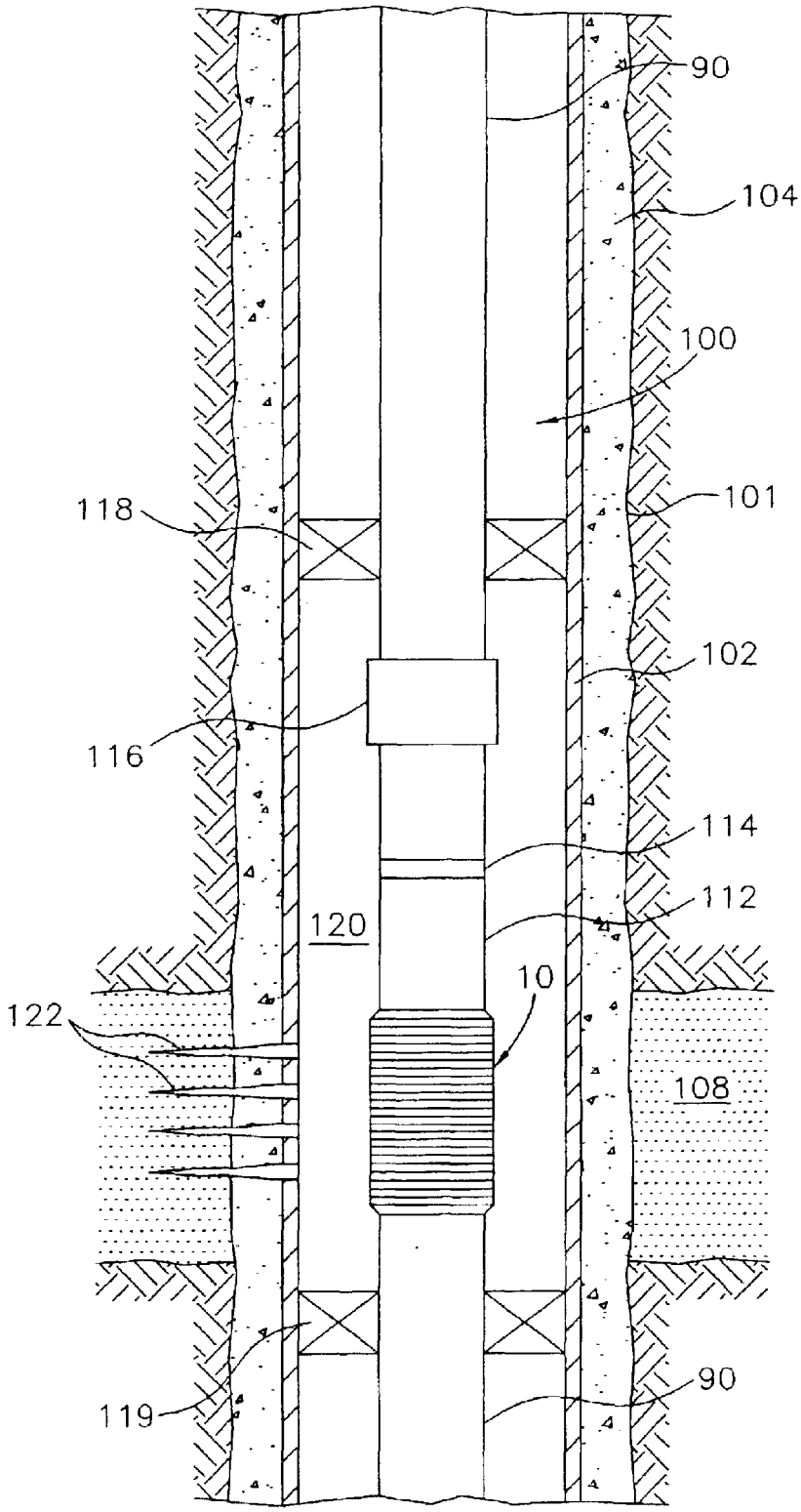
FIG. 4 is a partial cross sectioned, perspective view of one embodiment of the assembly of the present invention as positioned adjacent a subterranean formation of interest.

Referring to FIG. 4, a subterranean well 100 is illustrated as comprising a well bore 101, casing 102 and cement sheath 104. Well bore 101 is drilled from the surface of the earth in a conventional manner so as to penetrate at least one subterranean formation or zone of interest 108. A generally tubular casing string 102 is then positioned within well bore 101 and secured therein by means of a cement sheath 104 that is placed in the annulus between the casing string and the well bore in accordance with any conventional technique as will be evident to a skilled artisan. To complete well 100 in accordance with one embodiment of the present invention, assembly 10 of the present invention, blank pipe 112, isolation plug 114, closing sleeve 116 and packer 118 are assembled on tubing string 90 at desired spacing prior to or while tubing string 90 is run into well 100. Tubing string 90 is then lowered into well 100 and snapped into a sump packer 119 which may be previously run into well 100 and set to isolate production of fluid from subterranean formation or zone 108 from that portion of the well below sump packer 119. Other than assembly 10, the component parts assembled on tubing string 90 are conventionally available. For example, a suitable isolation plug is commercially available from Halliburton Energy Services, Inc. of Dallas, Tex. under the trade name designation PX, RX or NX plug and a suitable closing sleeve is commercially available from Halliburton Energy Services, Inc. under the trade name designation MCS closing sleeve or from Weatherford International, Inc. of Houston, Tex. under the trade name designation Frac Sleeve. The packer utilized in accordance with the present invention will vary with the exact method employed, and as such, may be permanent or retrievable, may be wireline deployed or tubing conveyed, and may have a seal bore or be run with tubing as will be evident to a skilled artisan. Examples of a wireline deployed, retrievable packer is that commercially available from Halliburton Energy Services, Inc. under the trademark Versa-Trieve®, of a tubing deployed, retrievable packer is that commercially available from Halliburton Energy Services, Inc. under the trade name designation Perma Latch, of a high temperature, high pressure version of either a wireline or tubing deployed, retrievable packer is that commercially available from Halliburton Energy Services, Inc. under the trade name designation HTHP, and of a tubing deployed, retrievable packer is that commercially available from Halliburton Energy Services, Inc. under the trade name designation RH.

As positioned within well 100, closing sleeve 116 is preferably placed in the open position. Wireline or coiled tubing may be used to open closing sleeve 116, if necessary such as in a high angle well. Once tubing string 90 is located at the desired position within well 100, i.e. such that assembly 10 is adjacent formation or zone 108, packer 118 is set either by hydraulic or mechanical means depending upon the packer employed as will be evident to a skilled artisan thereby effectively isolating formation or zone 108. At this point, the rig at the surface can be moved off location or may remain on location if appropriate for the completion operations. A coiled tubing unit and hydraulic fracturing equipment are moved on location. Hydraulic fracturing fluid is then pumped down tubing string 90 and is communicated via the opened sleeve 116 into the annulus defined between tubing string 90 and casing 102 and between packers 118 and 119. This fracturing fluid may be any fluid deemed to have the proppant carrying properties as dictated by the subterranean formation of interest and completion method employed. Suitable carrier fluids include gels, for example hydroxyethylcellulose or crosslinked polymers. Water will be sufficient for certain applications, such as a high rate water pack in which the primary emphasis is packing perforations and the annulus without fracturing the formation. The fracturing fluid is also communicated via port 42 to piston 43 in firing assembly 40. Pressure on the fracturing fluid is increased to a pressure that is significantly greater than the formation pressure until pins 44 shear causing firing pin 47 to strike percussion firing assembly 81 in firing head 70. The ignition of percussion firing assembly 81 causes a secondary detonation in ignition transfer 83 which in turn ignites detonating cord 35. Ignition of cord 35 detonates each perforating charge 34 which blasts through each adjacent scallop 32 in perforating charge carrier 30 and creates a perforation 122 which extends or penetrates through casing 102 and cement 104 and into subterranean formation or zone 108. Pins 44 are designed to shear at an predetermined pressure, e.g. a pressure greater than the fracturing pressure of the subterranean formation or zone 108 of interest. In this manner, immediately upon detonation of perforating charge(s) 34, the formation will be subjected to an condition that is in excess of the formation fracture gradient thereby fracturing the formation. Perforation(s) 122 will be surged with high pressure and fluid present in the annulus 120 will be injected into the formation or zone 108 at a high rate and pressure. Since perforation(s) 122 immediately upon creation thereof, the formation 108 is not allowed sufficient time to heal itself thereby increasing the efficiency and effectiveness of the fracturing process.

Once a pressure drop is noted at the surface indicating that the perforating charge(s) have fired and fluid has been injected into the formation, a frac pack operation is then performed via tubing string 90. Fluid is pumped via string 90 at a pressure in excess of the fracture gradient of formation or zone 108. Preferably, a "tip screen-out" technique is employed wherein a high concentration of proppant is pumped in the fracturing fluid near the end of the treatment. As proppant may be left in the tubing string 90, coiled tubing may be run Into the well to wash proppant out of the tubing and casing and to pull the isolation plug 114 from the well. The coil tubing may then be used to close sleeve 116 and the well may be pressure tested, production tested or placed on production.

Figure 5:
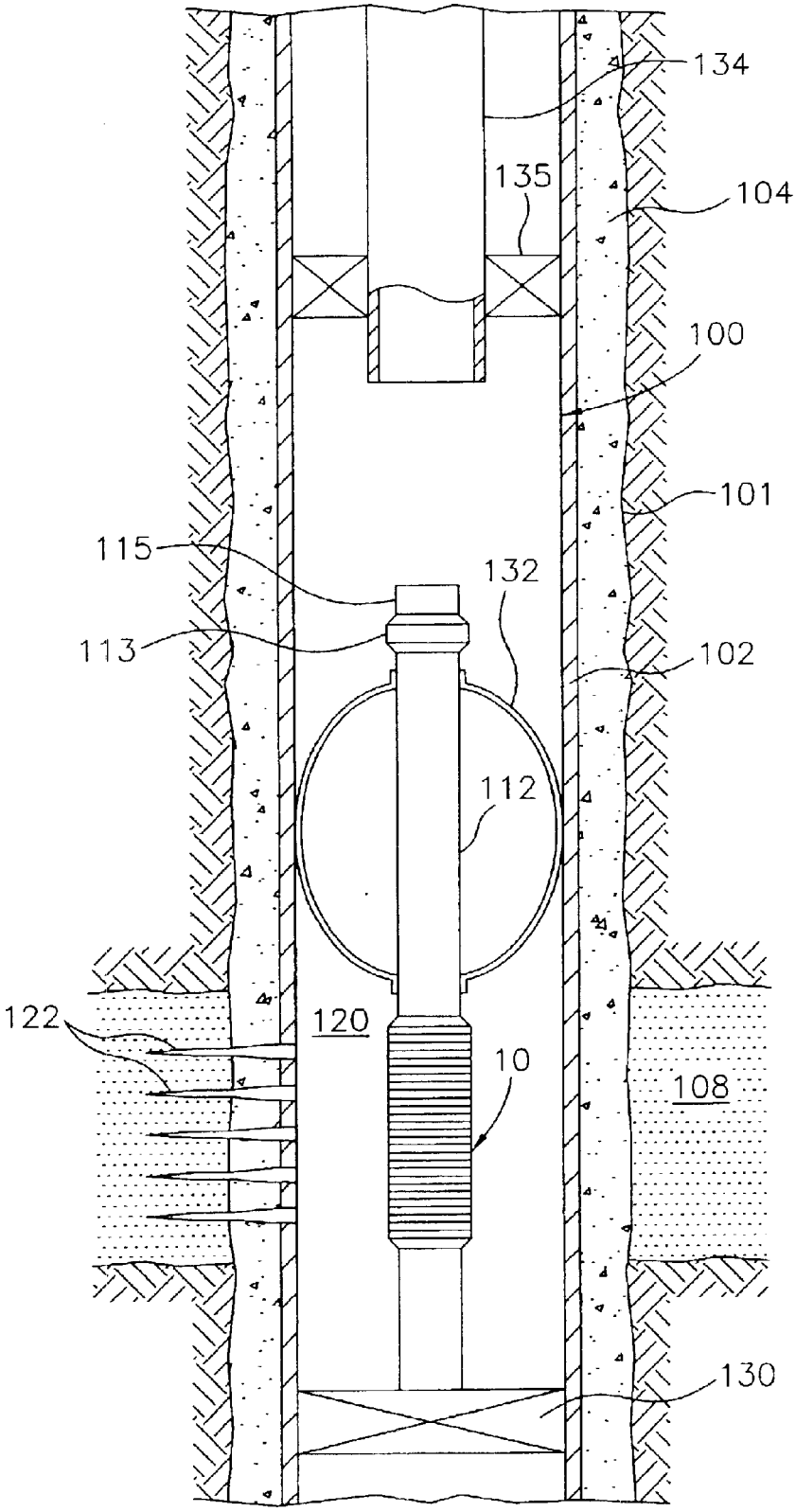
FIG. 5 is a partial cross sectioned, perspective view of another embodiment of the assembly of the present invention as positioned adjacent a subterranean formation of interest.

An alternative embodiment of the process of the present invention is illustrated in FIG. 5 in which a bridge plug 130, for example a cast iron bridge plug commercially available from Alpha Oil Tools of Fort Worth, Tex. under the trade name designation A-1 Bridge Plug or B-1 Bridge Plug, is set in casing 102 below the subterranean formation or zone of interest 108. The assembly 10 of the present invention is then lowered into well 100 by any suitable means, such as wireline, slick line or coiled tubing, and placed upon bridge plug 130. Assembly 10 is secured to a blank pipe 112 and a centralizer 132, for example a bow type centralizer, is secured to the outer surface of blank pipe 112 by any suitable means, such as by welds. A vent screen 113 is secured to the upper portion of blank pipe 112. As previously discussed the lower end of the screen assembly 10 is closed to fluid flow while the upper end of blank pipe 112 or vent screen 113 is closed to fluid flow by means of bull plug or retrievable fishing neck 115. If a retrievable fishing neck is employed, the neck is releasably secured to the upper end of blank pipe 112 or vent screen 113 by any suitable means, such as by shear pins. A tubing string 134 is positioned with well 100 and a packer 135 is hydraulically or mechanically set as will be evident to a skilled artisan to effectively isolating formation or zone 118. Thereafter, hydraulic fracturing fluid is pumped down tubing string 134 and is communicated via blank pipe 112 and port 42 to piston 43 in firing assembly 40. Pressure on the fracturing fluid is increased to an predetermined condition until pins 44 shear causing firing pin 47 to strike percussion detonator 81 in firing head 70. The ignition of percussion detonator 81 causes a secondary detonation in ignition transfer 83 which in turn ignites detonating cord 35. Ignition of cord 35 detonates each perforating charge 34 which blasts through each adjacent scallop 32 in perforating charge carrier 30 and creates a perforation 122 which extends or penetrates through casing 102 and cement 104 and into subterranean formation or zone 108. Pins 44 are designed to shear at an predetermined pressure, e.g. a pressure greater than the fracturing pressure of the subterranean formation or zone 118 of interest. in this manner, once perforating charge(s) 34 detonate, the formation will be subjected to an pressure that is in excess of the formation fracture gradient. Perforation(s) 122 will be surged with high pressure and fluid present in the annulus 120 will be injected into the formation or zone 108 at a high rate and pressure.

Figure 6:
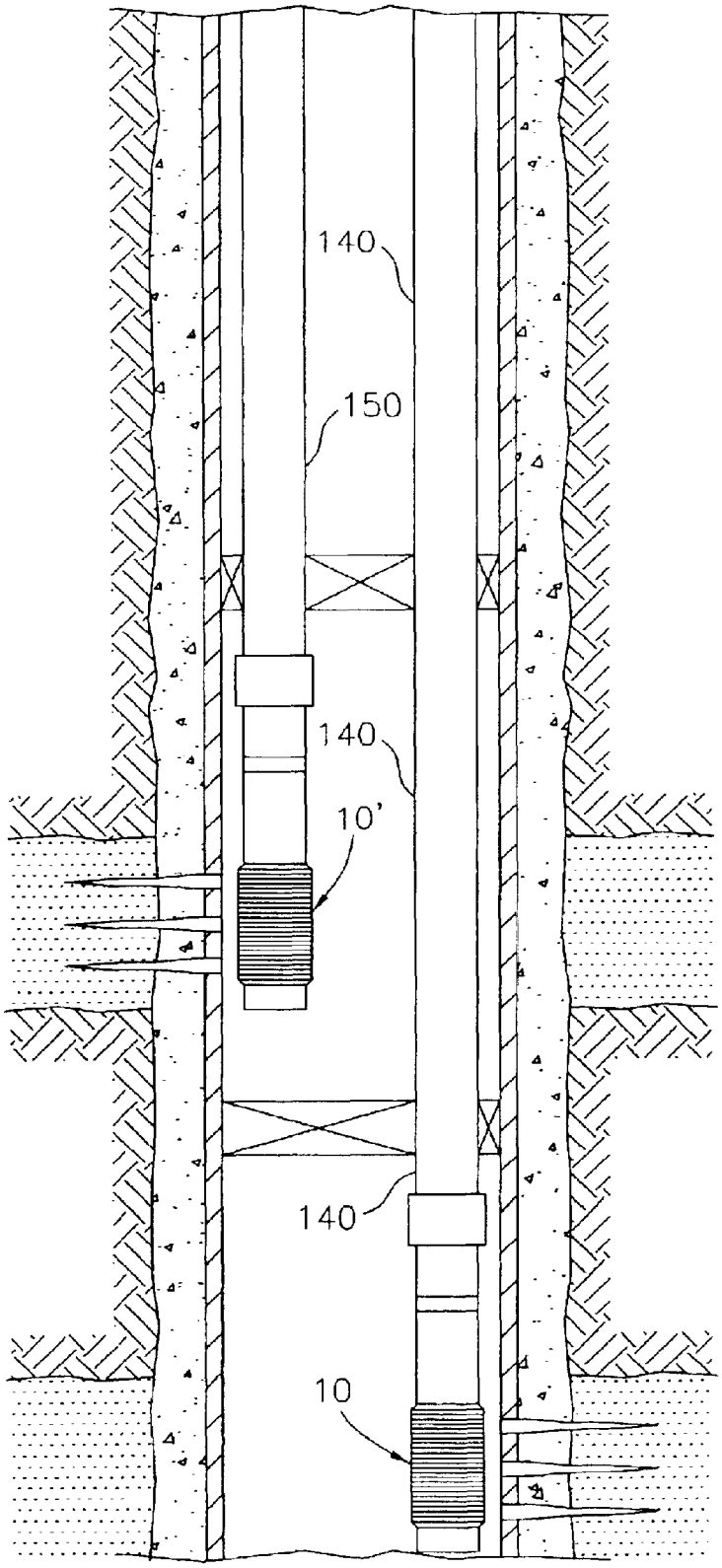
FIG. 6 is a partial cross sectioned, perspective view of yet another embodiment of the assembly of the present invention as positioned adjacent a subterranean formation of interest.

Once a pressure drop is noted at the surface indicating that the perforating charge(s) have fired and fluid has been injected into the formation, a frac pack operation is then performed via tubing string 134. Fluid is pumped via string 134 at a pressure in excess of the fracture gradient of formation or zone 108. Preferably, a "tip screen-out" technique is employed wherein a high concentration of proppant is pumped in the fracturing fluid near the end of the treatment. As proppant may be left in the tubing string 134 and in well 100 above the top of the vented screen 113, coiled tubing may be run into the well to wash proppant out of the tubing string 134 and well 100 to the location of vented screen 113. The removed proppant is then circulated with the wash fluid to the surface of the earth. The coiled tubing is removed and the well may be pressure tested, production tested or placed on production. As placed on production, fluid flows from formation 108 through the proppant pack present in perforations 108 and annulus 120 and into assembly 10 through screen assembly through screen assembly 50. Produced fluid then flows through blank pipe 112, outwardly through vented screen 113 and to the surface through tubing string 134. Alternatively, where a retrievable fishing neck is employed as 115, wireline, slick line or coiled tubing may be lowered through tubing string 134 prior to placing the well on production, secured to fishing neck 115 and raised to release fishing neck 115 from vented screen 113 or blank pipe 112. Once the fishing neck is retrieved from well 100, the well is placed on production and fluid is produced from the formation into assembly 10 and through the top of vented screen 113 of blank pipe 112 prior to entry into tubing string 134. As illustrated in FIG. 6, assembly 10 may be used in the upper and/or lower zone of a multiple well completion process in a similar manner to that described above with respect to FIG. 4 as long as the perforating charges in the upper assembly 10' are oriented to fire away from tubing string 140 so as not penetrate such string upon detonation.

The embodiments of the assembly and process of the present invention set forth above describe a combined perforating, fracturing and/or sand control tool that can be run into a subterranean well in a single trip and does not require that the tool be moved during operation. In accordance with the present invention, the perforating gun assembly 20 is not "dropped" during operation nor does the screen assembly 50 have to be "spaced out" across the subterranean zone of interest after perforating and prior to pumping fluid containing proppant. In this manner, pumping operations can be commenced immediately after perforating and sand control operations thereby eliminating the need for heavy completion fluid for pressure control in the well.

The following examples demonstrate the practice and utility of the present invention, but are not to be construed as limiting the scope thereof.

EXAMPLE 1

A well is drilled in the Gulf of Mexico, U.S.A. to 15,000 feet and is cased with 7" OD, 32.0 lb/ft casing. A casing cleanup and fluid displacement is performed to displace the drilling mud and cement from the casing, and to prepare it for completion operations. A bit and scraper/gauge run, with casing brushes, is used to ensure the integrity of the casing, and to clean the casing walls.

The formation of interest has an equivalent pore pressure of 16.5 ppg. In this straight hole, that equates to a bottom hole pressure of 12,870 psi. Based upon experience in the field, it is anticipated that the formation fracture gradient is 17.9 ppg, which is equivalent to about 14,000 psi. The mud in the casing is displaced with the relatively inexpensive calcium chloride completion fluid of 11.6 ppg density. This fluid exerts an equivalent pressure on bottom of 9048 psi.

The workstring is pulled from the well, and electric line is utilized to run a cast iron bridge plug to the desired depth near the bottom of the well, and within a few feet of the desired location of the bottom perforation. The centralized, dual firing head assembly of the present invention is made up with a bull plug on bottom, 60 feet of blank pipe above the assembly, a frac port within the blank pipe section (run in the open position), and a frac pack packer near the top of the blank pipe. This assembly is then run in the hole via electric line, and lightly tags the bridge plug. The assembly is picked up to get on depth and ready to perforate. Alternatively, a work string could be utilized to run the assembly in the well as will be evident to a skilled artisan.

The packer is set and electric line is pulled out of the hole. The production tubing assembly, with the seal assembly, is run and stung into the packer. The tubing is landed in the tubing hanger and the tree is nippled up. A tree saver assembly is utilized to protect the tree during frac packing operations, and the well is prepared for pumping operations.

A frac boat is mobilized to pump the frac pack, and upon its arrival on location, a high pressure flexible hose is lifted up to the rig and surface equipment, including a high pressure manifold assembly, is rigged up to the well. The boat is utilized to initiate blending of a gelled carrier fluid, and prepare the equipment for injecting proppant. The boat is set up to circulate the gelled fluid against pressure, and is ready to pump the fracture treatment immediately upon determination that the casing has been perforated.

The firing heads are set to fire at a pressure in excess of the fracture gradient of the formation of interest. In this case, with 11.6 ppg fluid in the hole and a 17.9 ppg frac gradient, it is determined that a differential pressure 1000 psi over fracture gradient is satisfactory. Accordingly, the guns are set to fire at a pressure of 15,000 psi. The pressure applied to the 11.6 ppg fluid to exert this pressure on the firing heads is 5914 psi at the surface.

While the boat is circulating fluid, a choke is gradually closed on the loop to increase the circulating pressure to greater than 5914 psi. A choke between the loop and the workstring is gradually opened as the pressure on the workstring is raised to 5914 psi. As soon as a pressure drop is observed, indicating that the guns have fired, the choke to the worksting is opened fully, and the fracture treatment is pumped as planned without allowing the pressure to drop below the formation fracture gradient. Additional pumps on the boat are then utilized to bring the injection rate up to the desired rate for the fracture treatment. The injection rate is stabilized by the time the gel pre-pad reached the formation.

The fracture treatment is terminated with a pumping schedule intended to induce a screenout via the tip-screenout method. This method results in proppant being left in the wellbore. Pressure is bled off abruptly to allow fractures in the formation to close and flow some of the proppant back to the wellbore in order to assure a good annular pack. Coiled tubing is utilized to wash proppant out of the tubing, and to close the frac sleeve in the blank pipe assembly. Alternately, electric line is used to close the sleeve after the proppant is washed form the well. After the frac sleeve is closed, coiled tubing and electric line are pulled out of the hole and the tree saver is removed from the wellhead. The well is flow tested and then put on production.

EXAMPLE 2

A well is drilled in a similar fashion to that described in Example at the same locale and to approximately the same depth. In this example, a vented screen is employed in the blank pipe above the assembly and the tubing string is run with a single packer above the screen assembly. The screen assembly is not connected to the tubing string or packer assembly. The tubing below the packer consists of a joint of tubing, a landing nipple, another joint of tubing, and a muleshoe.

The well can be completed in accordance with the process set forth in Example 1 and tree nippled up prior to perforating and pumping a gravel pack or frac pack. A tree saver will be used to protect the tree during pumping operations.

As in Example 1, pumping operations are configured such that upon determining that the guns have fired, pumping operations are continued until tip screenout. Coiled tubing is mobilized to wash proppant out of the well down to the top of the vented screen. After cleaning out the tubing/wellbore and rigging down the coiled tubing and the tree saver, the well is first tested and then brought online.

As will be evident to a skilled artisan, the methods of Examples 1 and 2 can be applied in cases where the tree is not nippled up prior to perforating. In these cases, it will be necessary to provide some mechanism to prevent the well from flowing during completion operations. The options may include running a flapper valve assembly in the packer extension to isolate the lower interval, setting a plug in the blank pipe, or killing the well with heavy weight completion fluid. Since the latter is one of the reasons for the development of this tool and process, it should be used only after it is determined that the other options are not feasible under the completion scenario.

Figure 7:
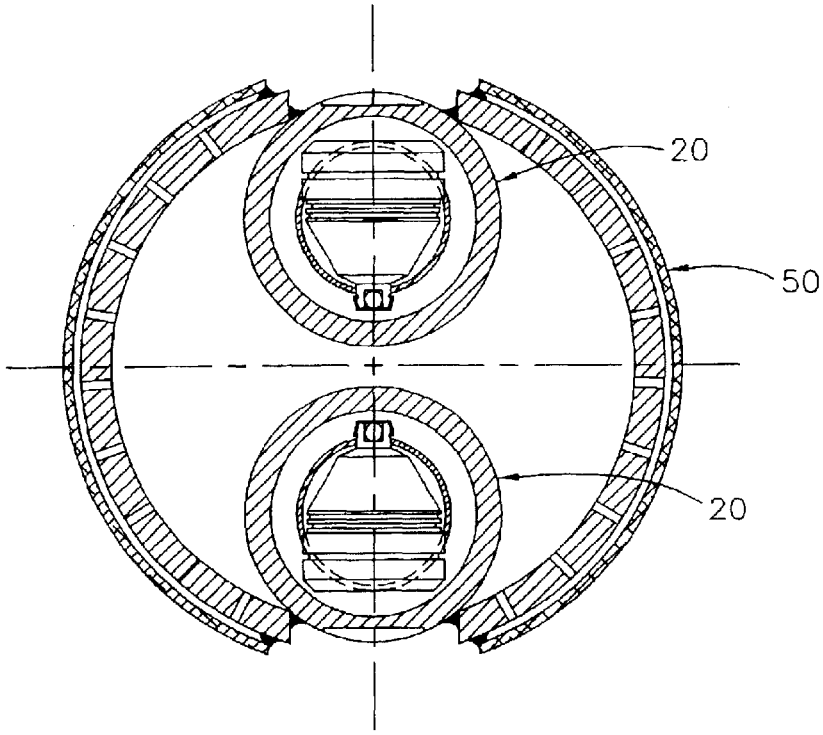
FIG. 7 is a cross sectional view taken through a screen assembly utilized in conjunction with the assembly and process of the present invention wherein two perforating charge carriers are positioned within the screen assembly.
Figure 8:
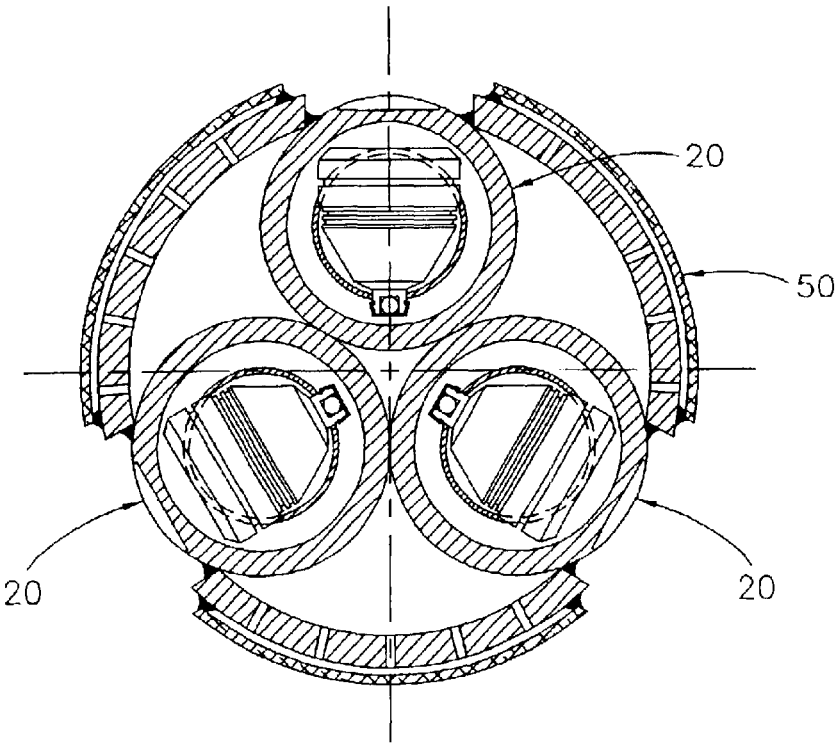
FIG. 8 is a cross sectional view taken through a screen assembly utilized in conjunction with the assembly and process of the present invention wherein three perforating charge carriers are positioned within the screen assembly.

Although assembly 10 of the present invention has been illustrated in FIGS. 1–6 as containing only perforating gun assembly having one set or row of spaced apart perforating charges which are aligned in a generally linear pattern, it is within the scope of the present invention as illustrated in FIGS. 7 and 8 to use multiple perforating gun assemblies having aligned perforating charges which are arranged in parallel within screen assembly 50. This parallel gun configuration may be employed where rotationally spaced perforations in a well and surrounding formation are desired for a specific subterranean completion application and where space within screen assembly 50 permits placement of multiple gun assemblies.

Figure 9:
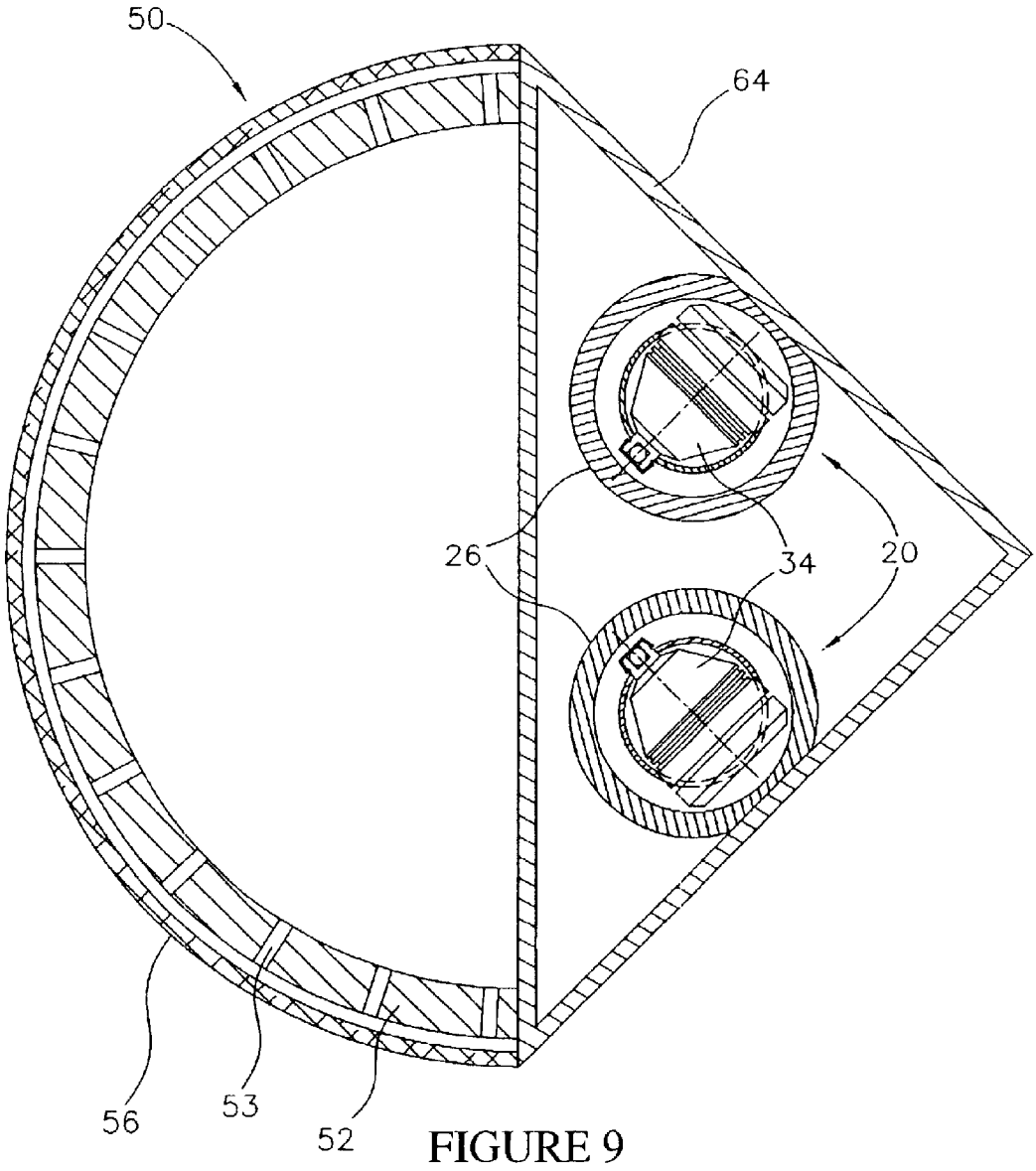
FIG. 9 is a cross sectional view taken through another embodiment of a screen assembly utilized in conjunction with the assembly and process of the present invention wherein at least one perforating gun assembly is positioned within a housing that is secured to a half pipe configured screen assembly.

Further, although the screen assembly 50 that is utilized in the assembly of the present invention has been illustrated in FIGS. 1–8 as being a pipe which has a generally annular cross sectional configuration, it is within the scope of the present invention to utilized other screen configurations, such as a trough or half pipe as is illustrated in FIG. 9. In this embodiment, the longitudinal edges of screen assembly 50 are secured to one side of an elongated housing 64 by any suitable means, for example by welds. In this embodiment, one or more perforating gun assemblies 20 are positioned within and secured to the housing 64 by any suitable means. Each charge 34 in said perforating gun assembly 20 is aimed to penetrate through charge carrier 26 and housing 64. Although illustrated in FIG. 9 as having a generally triangular cross sectional configuration, housing 64 may have any cross sectional configuration, for example rectangular or oblong, that can be sized to be positioned within a cased or open hole well bore as will be evident to a skilled artisan. Those portion(s) of housing 64 directly in front of perforating charges 34 may be provided with scallops to assist in penetration of housing 64 upon detonation as will be evident to a skilled artisan. In addition, it is within the scope of the present invention that housing 64 could serve as a carrier for the perforating charges 34 of the perforating gun assemblies positioned therein. In this manner, charge carriers 26 may be eliminated. When housing 64 functions as a carrier for perforating charges 34, housing 64 will have sufficient thickness to provide the structural integrity necessary for operation of the assembly and process of the present invention.

Figure 10:
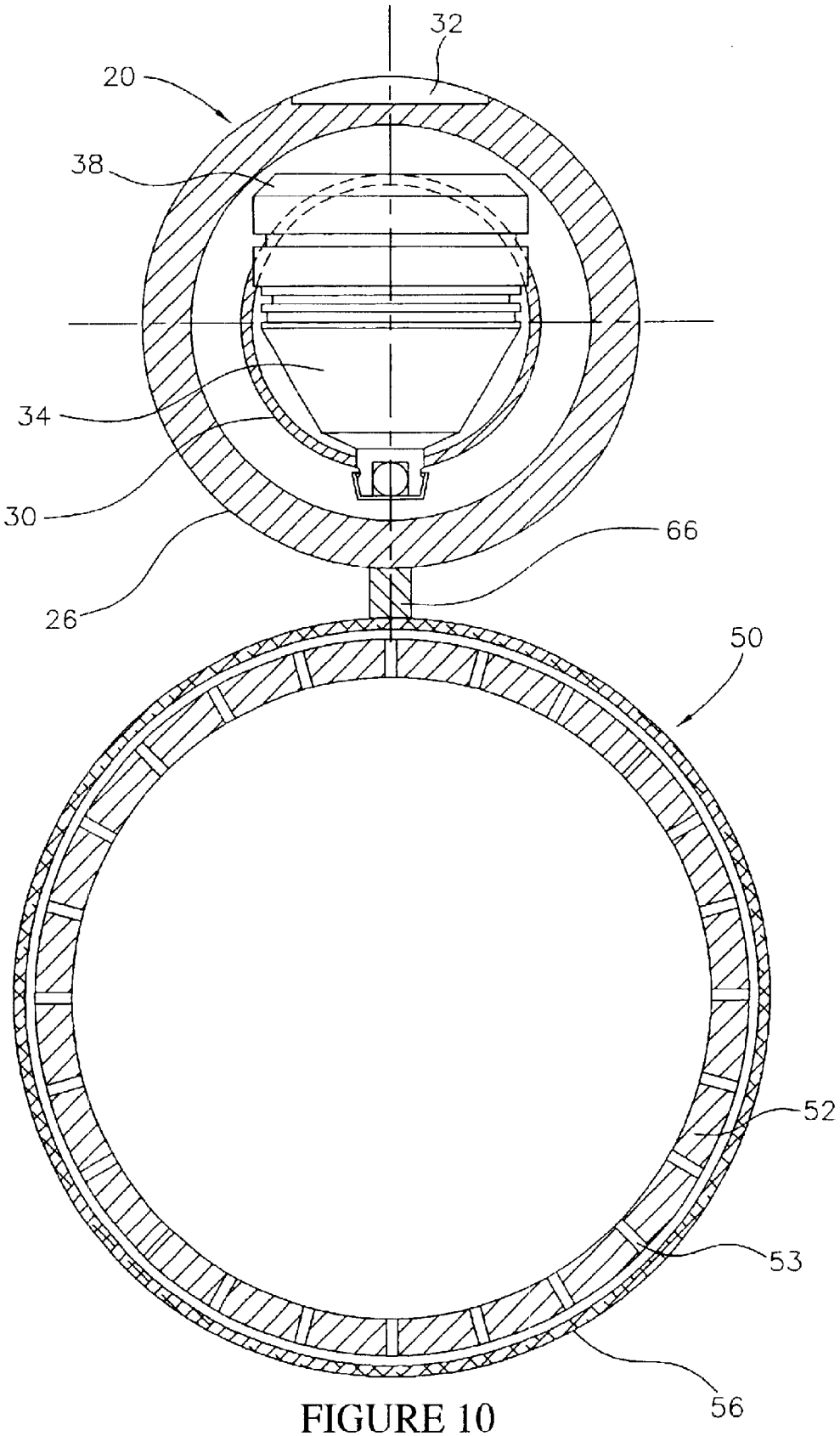
FIG. 10 is a cross sectional view taken through a further embodiment of a screen assembly utilized in conjunction with the assembly and process of the present invention wherein at least one perforating gun assembly is positioned outside of and secured to a screen assembly.

It is also within the scope of the present invention to position one or more perforating gun assemblies 20 on the outside of screen assembly 50 as illustrated in FIG. 10 and to secure each perforating gun assembly 20 to the screen 56 by means of at least one spacer or standoff 66. Each spacer or standoff 66 is secured to screen assembly 50 and perforating gun assembly 20 by any suitable means, for example by welds. In this embodiment, the charges 34 may be assembled with any phasing that does not affect the screen assembly 50. To ensure that the screen assembly 50 is not damaged upon detonation of the perforating gun assemblies during the process of the present invention, it is within the scope of the present invention to secure a shield (not illustrated) along that portion of screen assembly 50 that is closest to perforating gun assembly 20. The exact construction, configuration and assembly of a shield will be evident to a skilled artisan.

Further, multiple assemblies 10 of the present invention may be employed where the formation or zone of interest is of a sufficient thickness so as to require a larger length of perforations than can be formed using one assembly for proper completion. Where more than one assembly is employed in this embodiment of the present invention, the assemblies are arranged in series with adjacent assemblies mechanically and ballistically connected by means of a sub and booster transfer, respectively, as will be readily apparent to a skilled artisan.

The assembly and process of the present invention has been described and illustrated herein as being applied to a well bore having casing positioned therein. It will be evident to a skilled artisan that the assembly and process of the present invention is equally applicable to open hole applications, i.e. in subterranean well bores that are not cased. When utilized in an open hole, the assembly of the present invention is deployed as depicted in FIGS. 4 and 5 or in FIG. 6, detonation of the charges initiates fracturing of the subterranean zone of interest and the screen assembly 50 functions to prevent flow back of proppant into the production string.

While the foregoing preferred embodiments of the invention have been described and shown, it is understood that the alternatives and modifications, such as those suggested and others, may be made thereto and fall within the scope of the invention.

I claim:

1. A process for completing a subterranean well comprising:

positioning a screen and at least one perforating gun assembly in a subterranean well adjacent a subterranean formation, said at least one perforating gun assembly being secured to said screen and having at least one explosive charge; and detonating said at least one explosive charge thereby initiating penetration into said subterranean formation.

2. The process of claim 1 wherein said at least one perforating gun assembly is positioned within said screen as secured thereto.

3. The process of claim 1 wherein said well has casing positioned therein and said step of detonating also perforates said casing.

4. The process of claim 1 further comprising:

prior to said step of detonating, increasing the pressure on fluid present in said subterranean well until an overbalanced condition is reached, said step of detonating causing said fluid to fracture said subterranean formation.

5. A one trip well process for fracturing a subterranean formation and for completing a well penetrating the formation comprising:

pressuring fluid present in a subterranean well to an overbalanced condition; and forming perforations in said well which extend into a subterranean formation while a screen assembly is present in said well adjacent a said subterranean formation, said fluid causing said formation to fracture.

6. The one trip process of claim 5 comprising:

injecting a slurry of gravel into an annulus defined between said well and said screen assembly thereby packing said perforations with said gravel and forming a gravel pack in said annulus.

7. The one trip process of claim 6 further comprising:

producing fluid from said formation through said perforations, said gravel pack and said screen assembly to the surface of the earth.

8. A one trip well process for fracturing a subterranean formation and for completing a subterranean well penetrating the subterranean formation comprising:

positioning a screen assembly within the subterranean well adjacent the subterranean formation;

pressuring fluid present in the subterranean well to an overbalanced condition;

forming perforations in said well, said fluid causing the subterranean formation to fracture; and thereafter injecting a slurry of gravel into an annulus defined between the subterranean well and said screen assembly thereby packing said perforations with said gravel and forming a gravel pack in said annulus.

9. The one trip process of claim 8 further comprising:

producing fluid from said formation through said perforations, said gravel pack and said screen assembly to the surface of the earth.

10. The one trip process of claim 8 further comprising:

introducing a fluid into the subterranean well prior to said step of pressurizing.

11. A one trip process for completing a well comprising:

positioning at least one perforating gun assembly and a screen assembly in a well adjacent a subterranean formation, said at least one perforating gun assembly being secured to said screen assembly; and pressurizing fluid in said well to a predetermined condition thereby detonating said at least one perforating gun assembly so as to form perforations in said subterranean formation, said pressured fluid fracturing said formation via said perforations.

12. The one trip process of claim 11 further comprising:

introducing said fluid into said well prior to said step of pressurizing.

13. The one trip process of claim 12 further comprising:

producing fluid from said subterranean formation through said perforations, gravel in said annulus and screen assembly to the surface of the earth.

14. The one trip process of claim 11 further comprising:

introducing a slurry of gravel into an annulus formed between said well and said screen assembly thereby packing said perforations and annulus with gravel.

15. The one trip process of claim 11 wherein two perforating gun assemblies are secured to said screen assembly.

16. The one trip process of claim 11 wherein three perforating gun assemblies are secured within said screen assembly.

17. The one trip process of claim 11 where the predetermined condition is an overbalanced condition.

18. A well completion assembly comprising:

a screen assembly having at least one aperture;

at least one perforating gun assembly having at least one explosive charge, said at least one perforating gun assembly being positioned within and secured to said screen assembly such that each of said at least one explosive charge is aimed through said at least one aperture; and a pressure activated detonator connected to said at least one perforating gun assembly.

19. The well completion assembly of claim 18 wherein said at least one explosive charge is positioned within said screen assembly.

20. The well completion assembly of claim 18 wherein said at least one explosive charge extends outwardly from said screen assembly.

21. A one trip process for completing a well comprising:

securing at least one perforating gun assembly in a juxtaposed relationship to a screen assembly;

positioning said at least one perforating gun assembly and said screen assembly in a well adjacent a subterranean formation; and detonating said at least one perforating gun assembly so as to penetrate said subterranean formation.

22. The one trip process of claim 21 wherein penetration of said subterranean formation caused by detonating said at least one perforating gun assembly initiates fracturing of said subterranean formation.

23. A well completion assembly comprising:

a screen assembly having two apertures;

two perforating gun assemblies having at least one explosive charge and being positioned within and secured to said screen assembly such that said at least one explosive charge of one of the two perforating gun assemblies is aimed through one of said two apertures while said at least one explosive charge of the other of said two perforating gun assemblies is aimed through the other of said two apertures; and a pressure activated detonator connected to said at least one perforating gun assembly.

24. The well completion assembly of claim 23 wherein said two perforating gun assemblies are arranged in parallel.

* * * * *